US006947001B2

(12) United States Patent
Finn et al.

(10) Patent No.: US 6,947,001 B2
(45) Date of Patent: Sep. 20, 2005

(54) INFORMATION HANDLING SYSTEM INCLUDING PASSIVE RF TUNING CARRIER FOR WIRELESS MODULES

(75) Inventors: Larry W. Finn, Georgetown, TX (US); Patrick V. Illingworth, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 29 days.

(21) Appl. No.: 10/715,936

(22) Filed: Nov. 18, 2003

(65) Prior Publication Data

US 2005/0104785 A1 May 19, 2005

(51) Int. Cl.[7] ..... H01Q 1/24
(52) U.S. Cl. ..... 343/702; 455/557
(58) Field of Search ..... 343/700 MS, 702, 343/872, 873, 906, 720; 455/90, 557, 558, 556.1

(56) References Cited

U.S. PATENT DOCUMENTS

| | | | | |
|---|---|---|---|---|
| 6,538,606 | B2 | 3/2003 | Quinn et al. | 343/702 |
| 6,618,014 | B2 * | 9/2003 | Stoiljkovic et al. | 343/702 |
| 6,670,926 | B2 * | 12/2003 | Miyasaka | 343/702 |
| 6,677,906 | B2 | 1/2004 | Quinn et al. | 343/702 |
| 6,687,120 | B2 | 2/2004 | Hood et al. | 361/683 |
| 2004/0183731 | A1 * | 9/2004 | Darden et al. | 343/702 |
| 2004/0198443 | A1 * | 10/2004 | Miyasaka | 455/557 |

* cited by examiner

*Primary Examiner*—Hoang V. Nguyen
(74) *Attorney, Agent, or Firm*—Haynes and Boone, LLP

(57) ABSTRACT

An antenna assembly includes a antenna carrier having an antenna module receiving region. The antenna module includes an antenna and a radio frequency transceiver coupled to the antenna. The antenna carrier includes a passive tuning element situated adjacent to the module receiving region, the element exhibiting a length selected to cause the antenna to resonate at a predetermined frequency when the antenna module is placed in the module receiving region.

29 Claims, 4 Drawing Sheets

INFORMATION HANDLING SYSTEM INCLUDING PASSIVE RF TUNING CARRIER FOR WIRELESS MODULES

BACKGROUND

The present disclosure relates generally to information handling systems (IHSs), and more particularly to a tuning carrier for a radio frequency transceiver antenna.

As the value and use of information continue to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

A continuing problem associated with IHSs and IHS components is limited mobility. It has become desirable to limit or eliminate cables and other immobilizing connection devices used to transmit and receive information from system to system or within the system itself.

Wireless connections require radio frequency (RF) transceivers with antennas in order to allow transmission and reception of information while achieving high mobility. Integrating the RF transceivers into IHS platforms presents problems with antenna performance. This occurs because the antenna for a particular system is designed to transmit and receive within a particular frequency band. Unfortunately, when the RF transceiver is mounted in close proximity to other components in an information handling system, those components can shift the frequency band at which the antenna has been designed to operate. This results in the antenna transmitting and receiving less than optimally. Such degradation varies from system to system depending on the particular placement of the antenna in the IHS. The IHS designer may need to move the transceiver among several mounting locations within the IHS until acceptable results are achieved.

In addition to changing the transceiver mounting location, other steps may be taken to remedy the problem. The antenna can be designed to compensate for the degradation caused by the components in the near field of the transceiver and antenna However, this requires a different RF transceiver/antenna for any given system, each transceiver/antenna of which must be certified by the Federal Communications Commission. This ignores economies of scale, and requires that the RF transceiver design wait until the system design is finished.

Alternatively, the IHS can be designed so that its components allow the RF transceiver antenna to transmit and receive in its intended optimal frequency band. This solution is undesirable because it requires each system to be designed around the RF transceiver.

Accordingly, it would be desirable to provide an RF transceiver assembly in an IHS absent the disadvantages found in the methods discussed above.

SUMMARY

According to one embodiment, an antenna assembly includes a antenna carrier having an antenna module receiving region. The antenna module includes an antenna and a radio frequency transceiver coupled to the antenna. The antenna carrier includes a passive tuning element situated adjacent to the module receiving region, the element exhibiting a length selected to cause the antenna to resonate at a predetermined frequency when the antenna module is placed in the module receiving region.

A principal advantage of this embodiment is that a radio frequency transceiver may operate in a platform at its optimal frequency band despite interaction with nearby platform components. The carrier provides a standardized mounting location for the radio frequency transceiver and its passive tuning element can be adjusted to allow use of the radio frequency transceiver in a variety of platforms.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
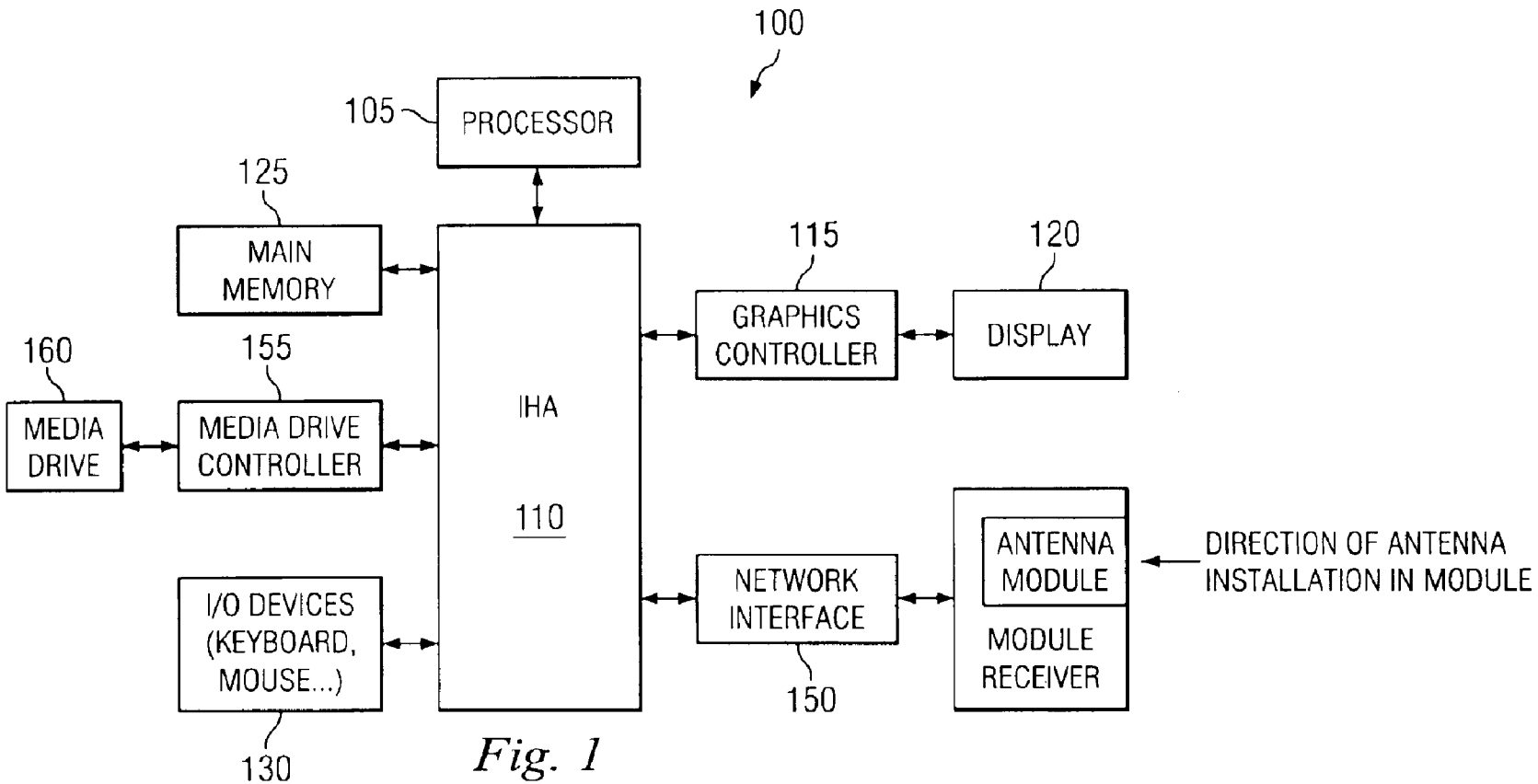
FIG. 1 is a block diagram illustrating one embodiment of the disclosed information handling system.

FIG. 1 shows one embodiment of information handling system (IHS) 100 including a processor 105 which is connected to an Intel Hub Architecture (IHA) chipset 110. Chipset 110 serves as a connection between processor 105 and other components of information handling system 100. A graphics controller 115 couples a display 120 to processor 105. A main memory 125 is coupled to processor 105 to provide the processor with fast storage to facilitate execution of computer programs by processor 105. Input/output devices 130 are coupled to processor 105 to provide input to processor 105. Examples of input devices include keyboards, touchscreens, and pointing devices such as mouses, trackballs and trackpads. Programs and data are stored on a media drive 160, which is coupled to processor 105 by media drive controller 155. Media drives include such devices as hard disks, optical disks, magneto-optical drives, floppy drives and the like. A network interface 150 allows the coupling of devices to IHA chipset 110 that assist in the connection of information handling system 100 to other systems. It should be understood that other busses and intermediate circuits can be deployed between the components described above and processor 105 to facilitate interconnection between the components and the microprocessor.

Figure 2:
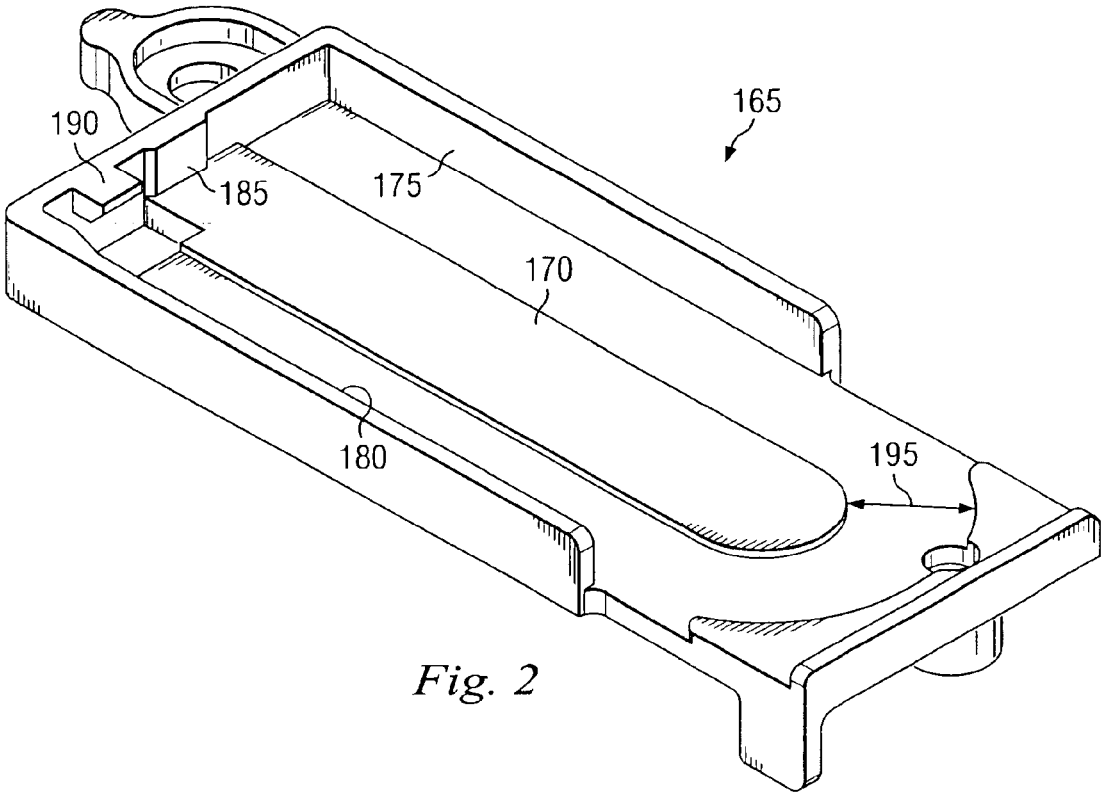
FIG. 2 is a perspective view of an embodiment of an antenna carrier employed by the IHS of FIG. 1.
Figure 3:
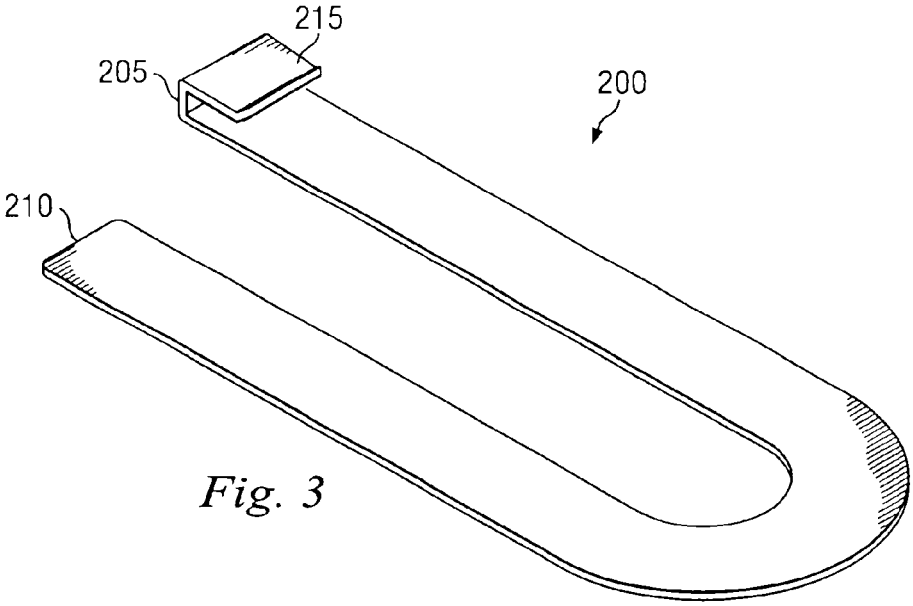
FIG. 3 is a perspective view illustrating an embodiment of representative passive tuning element employed by the antenna carrier of FIG. 2.
Figure 4:
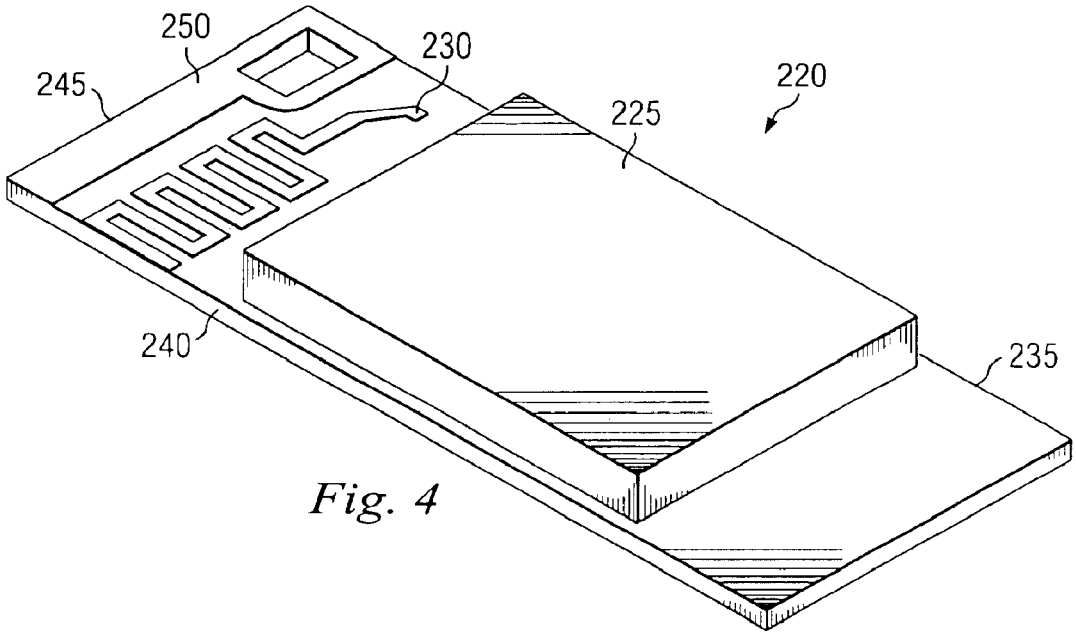
FIG. 4 is a perspective view illustrating an embodiment of a representative antenna module employed by the IHS of FIG. 1.

An antenna carrier 165, FIG. 2, includes an antenna module receiving surface 170. Guide members 175 and 180 extend from different edges of antenna carrier 165, substantially perpendicular to antenna module receiving surface 170. A stop surface 185 extends from an edge of the antenna carrier 165, substantially perpendicular to antenna module receiving surface 170. A retention member 190 extends from stop surface 185. A tuning element recess 195 exists on antenna module receiving surface 170 for holding a passive tuning element 200 (shown in FIG. 3) on antenna carrier 165. As seen in FIG. 3, passive tuning element 200 exhibits a U-shape and has a ground end 205 and a tuning end 210. Ground end 205 includes a retention clip 215 which is used for retaining an antenna module 220 (shown in FIG. 4) in antenna carrier 165. As seen in FIG. 4, a radio frequency transceiver 225 is mounted on antenna module 220 and is used for transmitting and receiving information. An antenna 230 is coupled to radio frequency transceiver 225 and resonates at a predetermined frequency band. Guide surfaces 235 and 240 are substantially parallel to each other and are situated on opposite ends of antenna module 220. A stop surface 245 is substantially perpendicular to guide surfaces 235 and 240. A ground area 250 is located adjacent to stop surface 245.

Figure 5:
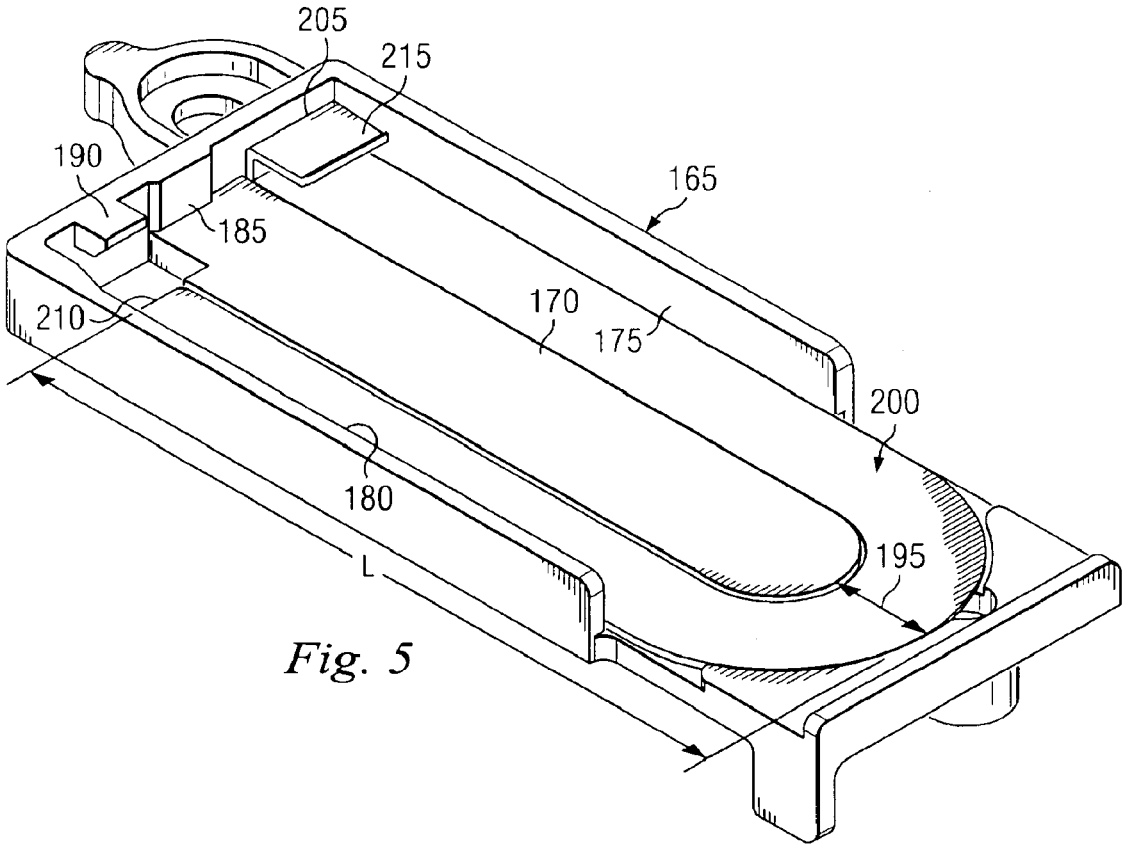
FIG. 5 is a perspective view illustrating an embodiment of representative passive tuning element seated in an antenna carrier.
Figure 6:
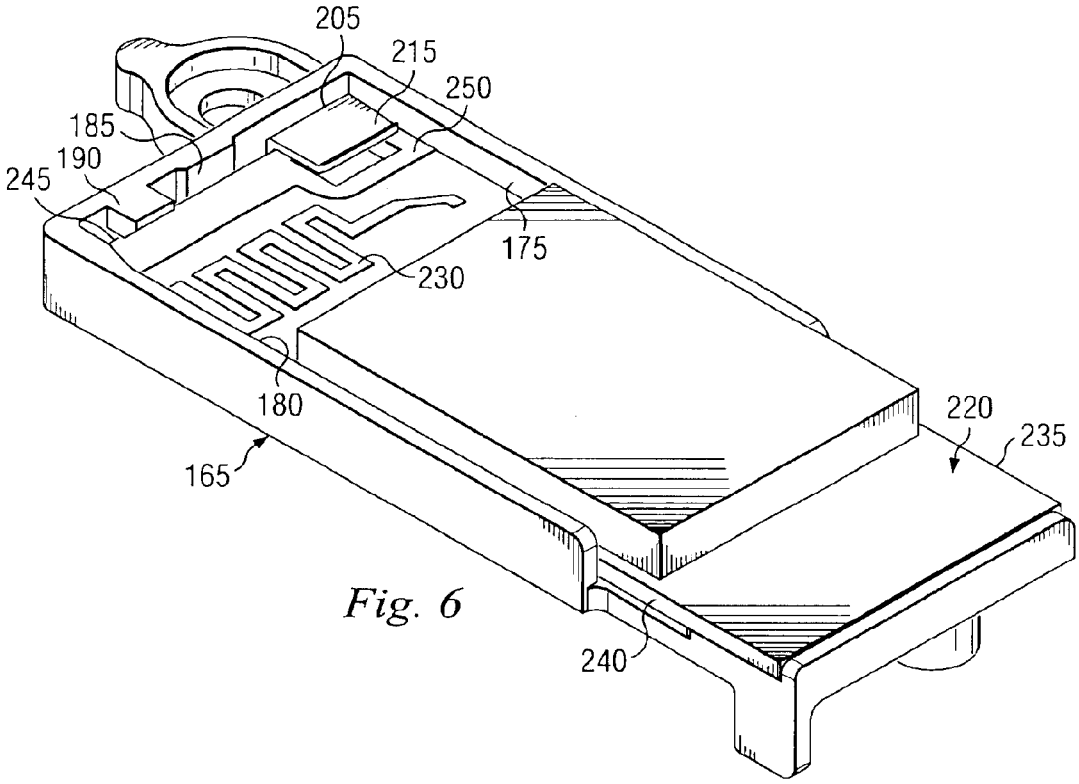
FIG. 6 is a perspective view illustrating the antenna module of FIG. 4 secured in the antenna carrier of FIG. 5

In operation, FIGS. 5 and 6, passive tuning element 200 is seated in tuning element recess 195 on antenna module receiving surface 170. Tuning element recess 195 is the shape of passive tuning element 200 and at a depth on antenna module receiving surface 170 such that when passive tuning element 200 is seated in tuning element recess 195, passive tuning element 200 is flush with antenna module receiving surface 170. As seen in FIG. 6, antenna module 220 is slidably received by antenna carrier 165 by lining up guide surfaces 235 and 240 between guide members 175 and 180 and sliding antenna module 220 onto antenna carrier 165 until stop surface 245 engages stop member 185. Engaging stop surface 245 and stop member 185 connects ground end 205 of passive tuning element 200 with ground area 250 of antenna module 220 and grounds passive tuning element 200. Retention clip 215 secures antenna module 220 in antenna carrier 165 while helping ground passive tuning element 200. Retention element 190 further secures antenna module 220 in antenna carrier 165.

When antenna module 220 is secured in antenna carrier 165, tuning end 210 of passive tuning element 200 is located adjacent to antenna 230 on antenna module 220. By positioning tuning end 210 at different locations on the antenna module receiving surface 170, antenna 230 can be made to resonate at different frequencies to compensate for the effects of objects in the IHS which are near antenna 230. In the preferred embodiment shown in FIG. 6, tuning end 210 is situated directly below antenna 230. Other embodiments are possible wherein tuning end 210 is situated in other locations below antenna module 220, both adjacent to antenna 230 and distant from antenna 230. In other words, as shown in FIG. 5, length L, or other dimensions of passive tuning element 200, can be varied to change the resonant frequency of the antenna even though the dimensions of antenna 230 are fixed. While in the preferred embodiment shown in FIG. 5, passive tuning element 200 exhibits a U shaped geometry, other geometries such as a V shape, J shape, L shape, and I shape, for example, may be employed as well depending upon the particular application.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. An antenna assembly comprising:

a antenna carrier including an antenna module receiving region;

an antenna module including first and second module surfaces opposed to one another, the antenna module including an antenna situated on the first module surface, the antenna module further including a radio frequency transceiver coupled to the antenna; and the antenna carrier including a passive tuning element situated adjacent the module receiving region, the passive tuning element exhibiting dimensions selected to cause the antenna to resonate at a predetermined frequency when the antenna module is placed in the module receiving region.

2. The antenna assembly of claim 1 wherein the passive tuning element exhibits a length which is among the dimensions selected to cause the antenna to resonate at the predetermined frequency.

3. The antenna assembly of claim 1 wherein the antenna carrier slidably receives the antenna module therein.

4. The antenna assembly of claim 1 wherein the passive tuning element exhibits a U-shape.

5. The antenna assembly of claim 1 further comprising:

an antenna module retention member on the passive tuning element that secures the antenna module in the antenna carrier.

6. The antenna assembly of claim 5 wherein the antenna module retention member engages a ground area of the antenna module when the antenna module is secured in the antenna carrier.

7. The antenna assembly of claim 1 further comprising:

a module receiving surface on the module receiving region; and a recess on the module receiver surface whereby the passive tuning element is situated in the recess and flush with the module receiver surface.

8. An information handling system (IHS) comprising:

a processor;

an antenna carrier including an antenna module receiving region for receiving an antenna module therein, the antenna module being coupled to the processor; and a passive tuning element situated adjacent the module receiving region, the passive tuning element exhibiting dimensions selected to cause an antenna to resonate at a predetermined frequency when the antenna module is received in the module receiving region.

9. The IHS of claim 8 including a network interface which couples the antenna module to the processor.

10. The IHS of claim 8 wherein the antenna carrier slidably receives the antenna module in the antenna module receiving region.

11. The IHS of claim 8 wherein the passive tuning element exhibits a length which is among the dimensions exhibited by the antenna to cause the antenna to resonate at the predetermined frequency.

12. The IHS of claim 8 wherein the passive tuning element exhibits a U-shape.

13. The IHS of claim 8 further comprising:

a module receiving surface on the module receiving region; and a recess on the module receiver surface whereby the passive tuning element is situated in the recess and flush with the module receiver surface.

14. The IHS of claim 8 further comprising:

an antenna module retention member on the passive tuning element that secures the antenna module in the antenna carrier.

15. An information handling system (IHS) comprising:

a processor;

an antenna module including an antenna, the antenna module further including a radio frequency transceiver coupled to the antenna and the processor; and an antenna carrier including a module receiving region for receiving the antenna module therein, the antenna carrier including a passive tuning element situated adjacent the module receiving region, the passive tuning element exhibiting dimensions selected to cause the antenna to resonate at a predetermined frequency when the antenna module is placed in the module receiving region.

16. The IHS of claim 15 wherein the passive tuning element exhibits a length which is among the dimensions exhibited by the antenna to cause the antenna to resonate at the predetermined frequency.

17. The IHS of claim 15 wherein the antenna carrier slidably receives the antenna module therein.

18. The IHS of claim 15 wherein the passive tuning element exhibits a U-shape.

19. The IHS of claim 15 further comprising:

an antenna module retention member on the passive tuning element that secures the antenna module in the antenna carrier.

20. The IHS of claim 19 wherein the antenna module retention member engages a ground area of the antenna module when the antenna module is secured in the antenna carrier.

21. The IHS of claim 15 further comprising:

a module receiving surface on the module receiving region; and a recess on the module receiver surface whereby the passive tuning element is situated in the recess and flush with the module receiver surface.

22. An information handling system (IHS) comprising:

a processor;

an antenna carrier including an antenna module receiving region for receiving an antenna module therein;

the antenna module being coupled to the processor and including first and second module surfaces oppose to one another, the antenna module including an antenna situated on the first module surface, the antenna module further including a radio frequency transceiver coupled to the antenna; and the antenna carrier including a passive tuning element situated adjacent the module receiving region, the passive tuning element exhibiting dimensions selected to cause the antenna to resonate at a predetermined frequency when the antenna module is placed in the module receiving region.

23. The IHS of claim 22 wherein the antenna carrier slidably receives the antenna module therein.

24. The IHS of claim 22 wherein the passive tuning element exhibits a U-shape.

25. The IHS of claim 22 further comprising:

an antenna module retention member on the passive tuning element that secures the antenna module in the antenna carrier.

26. The IHS of claim 25 wherein the antenna module retention member engages a ground area of the antenna module when the antenna module is secured in the antenna carrier.

27. The IHS of claim 22 further comprising:

a module receiving surface on the module receiving region; and a recess on the module receiver surface whereby the passive tuning element is situated in the recess and flush with the module receiver surface.

28. A method of tuning an antenna in an information handling system comprising:

providing a processor;

providing an antenna carrier including an antenna module receiving region for receiving an antenna module therein;

coupling the antenna module to the processor;

providing an antenna situated on the antenna module;

providing a radio frequency transceiver coupled to the antenna;

providing a passive tuning element situated adjacent the module receiving region in the antenna carrier; and tuning the antenna module by selecting the length of the passive tuning element to cause the antenna to resonate at a predetermined frequency when the antenna module is placed in the module receiving region.

29. An information handling system (IHS) comprising:

a processor;

an antenna carrier including an antenna module receiving region for receiving an antenna module therein;

the antenna module coupled to the processor;

an antenna situated on the antenna module;

a passive tuning element situated adjacent the module receiving region in the antenna carrier; and the antenna module being tuned by selecting the length of the passive tuning element to cause the antenna to resonate at a predetermined frequency when the antenna module is place in the module receiving region.

* * * * *